United States Patent [19]

Kondo et al.

[11] 4,447,515

[45] May 8, 1984

[54] PHOTOCONDUCTIVE COMPOSITION AND ELECTROPHOTOGRAPHIC LIGHT-SENSITIVE MATERIAL USING IT

[75] Inventors: Syun-ichi Kondo; Kenji Sano; Hideo Sato, all of Saitama, Japan

[73] Assignee: Fuji Photo Film Co., Ltd., Kanagawa, Japan

[21] Appl. No.: 461,712

[22] Filed: Jan. 28, 1983

[30] Foreign Application Priority Data

Jan. 28, 1982 [JP] Japan ..... 57-10868

[51] Int. Cl.[3] ..... G03G 5/06

[52] U.S. Cl. ..... 430/83; 430/31; 430/56; 430/570; 430/81

[58] Field of Search ..... 430/31, 56, 83, 570, 430/81

[56] References Cited

U.S. PATENT DOCUMENTS 4,154,610 5/1979 Katoh ..... 430/207 X

*Primary Examiner*—John D. Welsh

*Attorney, Agent, or Firm*—Sughrue, Mion, Zinn, Macpeak and Seas

[57] ABSTRACT

A photoconductive composition is disclosed which is comprised of an organic photoconductor and a diacylamine compound. The composition may also contain a sensitizing dye for sensitizing the organic photoconductor. In addition there is disclosed an electrophotographic light-sensitive material having on a conductive support a photoconductive light-sensitive layer composed of the foregoing photoconductive composition. The addition of the diacylamine compound greatly increases the light sensitivity of the photoconductive composition containing an organic photoconductor.

10 Claims, No Drawings

PHOTOCONDUCTIVE COMPOSITION AND ELECTROPHOTOGRAPHIC LIGHT-SENSITIVE MATERIAL USING IT

FIELD OF THE INVENTION

This invention relates to a photoconductive composition mainly composed of an organic photoconductor and an electrophotographic light-sensitive material using the composition as the electrophotographic light-sensitive layer. More particularly, the invention relates to a high-sensitive photoconductive composition mainly composed of an organic photoconductor and a diacylamine compound and a high-sensitive electrophotographic light-sensitive material using the composition as the electrophotographic light-sensitive layer.

BACKGROUND OF THE INVENTION

Conventional photoconductors for electrophotographic light-sensitive compositions are comprised of various organic compounds and some of these compounds have considerably high light sensitivity. However, organic photoconductors for electrophotographic light-sensitive materials are not commonly used at present.

Organic photoconductors have many excellent properties as compared to inorganic photoconductors and may be applied to numbers of different techniques in the technical field of electrophotography. For example, organic photoconductors now make it possible to produce a transparent electrophotographic light-sensitive film, a flexible electrophotographic light-sensitive film, and a light-weight and easily handlable electrophotographic light-sensitive film. Also, organic photoconductors have properties, which cannot be expected from inorganic photoconductors or inorganic semi-conductors, such as the film-forming property and surface smoothness at the production of electrophotographic light-sensitive materials and the selectivity of charging polarity in an electrophotographic process.

In spite of having these excellent properties, organic photoconductors have not yet been able to sufficiently contribute to the technical field of electrophotography mainly due to their low light sensitivity and the brittleness of films or layers.

Preliminary studies of organic photoconductors were made on compounds such as low molecular heterocyclic compounds, nitrogen-containing aromatic compounds, and various high molecular type aromatic compounds. As a result of these studies, organic photoconductors having considerably high sensitivity were found. Recently, however, sensitizing methods have been investigated for obtaining higher sensitivity. This is because even an organic photosemiconductive compound having the highest sensitivity presently known does not have sufficient sensitivity for practical use of the compound without requiring the application of a sensitizing treatment. Accordingly, during the practical application of organic photoconductors it is necessary to select the most effective sensitizing method. The industrial value of an organic photoconductor depends substantially on how highly sensitized electrophotographic light-sensitive material can be made by using the organic photoconductor.

The most generally known sensitizing method is the addition of a sensitizing dye or the addition of Lewis acid. Such methods can be applied to almost all organic photoconductors. The former method provides sensitization by imparting the spectral absorption characteristics of a sensitizing dye to an organic photoconductor and the latter method provides sensitization by forming a donor-acceptor complex between the Lewis acid and an organic photoconductor to give a new spectral sensitivity.

SUMMARY OF THE INVENTION

As the result of various investigations on developing an effective sensitizing method for organic photoconductors, the inventors have discovered that the light sensitivity of an organic photoconductor can be remarkably increased by the addition of a diacylamine compound, in particular, the diacylamine compound represented by the following general formula (I) to the photoconductor:

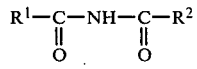

$$R^1-\underset{\underset{O}{\|}}{C}-NH-\underset{\underset{O}{\|}}{C}-R^2 \qquad (I)$$

wherein $R^1$ and $R^2$ each represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic condensation aryloxy group, or a monovalent group induced from a substituted or unsubstituted heterocyclic ring.

A first object of this invention is to provide a highly sensitized photoconductive composition.

A second object of this invention is to provide an electrophotographic light-sensitive material having a high sensitivity.

The invention provides a photoconductive composition containing an organic photoconductor and a diacylamine compound.

Also, the invention provides an electrophotographic light-sensitive material comprising a support, at least the surface of which has a conductivity, having formed thereon an electrophotographic light-sensitive layer composed of a photoconductive composition containing an organic photoconductor and a diacylamine compound.

DETAILED DESCRIPTION OF THE INVENTION

Various materials can be used in this invention as the organic photoconductors, but materials which can be sensitized by a dye are preferred. Practical examples of organic photoconductors used in this invention are listed below.

(i) High molecular organic photoconductor:

These compounds are polycyclic aromatic or heteroaromatic vinyl polymerization type high molecular organic photoconductors each having $\pi$-electrons.

Typical examples of nuclei having $\pi$-electrons constituting the high molecular organic photoconductors are nuclei of polycyclic aromatic hydrocarbons such as naphthalene, anthracene, pyrene, perylene, acenaphthene, phenylanthracene, diphenylanthracene, etc.; nuclei of heteroaromatic compounds such as carbazole, indole, acridine, 2-phenylindole, N-phenylcarbazole, etc.; and halogen-substituted compounds and lower alkyl-substituted compounds of them. In this invention, vinyl polymers containing these nuclei are used as photoconductors. For example, there are vinyl polymers such as polyvinylnaphthalene, polyvinylanthracene, polyvinylpyrene, polyvinylperylene, polyacenaphthylene, polystyryl anthracene, polyvinylcarbazole, polyvinyl indole, polyvinylacridine, etc.; vinyl copolymers containing the above vinyl compound such as vinyl naphthalene, vinyl acenaphthylene, vinyl anthracene, vinyl carbazole, etc.; vinyl ether polymers such as polyanthrylmethyl vinyl ether, polypyrenylmethyl vinyl ether, polycarbazolylethyl vinyl ether, polyindolylethyl vinyl ether, etc.; epoxy resins such as polyglycidylcarbazole, polyglycidylindole, poly-p-glycidylanthrylbenzene, etc.; polymers or copolymers of acrylic acid ester or methacrylic acid ester containing the foregoing nucleus having $\pi$-electrons as a substituent; and condensed polymers of foregoing $\pi$-electron series compounds and formaldehyde. The molecular weight of the polymers containing the $\pi$-electron systems ranges 100 to 1,000,000, preferably 1,000 to 100,000.

In the foregoing polymers, poly-N-vinylcarbazole, substituted poly-N-vinylcarbazole having a substituent such as an aryl group, an alkylaryl group, an amino group, an alkylamino group, a dialkylamino group, an arylamino group, a diarylamino group, an N-alkyl-N-arylamino group, a nitro group, a halogen atom, etc., at the carbazole ring (hereinafter, they are referred to as poly-N-vinyl substituted carbazoles), and N-vinylcarbazole copolymers are preferred.

Useful N-vinylcarbazole copolymers include a copolymer having at least 50 mole%, preferably at least 70 mole%, the N-ethylenecarbazole constitutional repeating unit having the following formula:

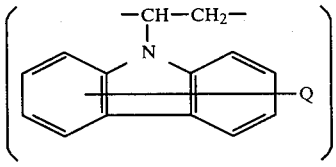

wherein Q represents the same substituents as the substituents of the foregoing poly-N-vinyl substituted carbazoles. As the remaining constitutional repeating unit of the N-vinylcarbazole copolymer, there are 1-phenylethylene, 1-cyanoethylene, 1-cyano-1-methylethylene, 1-chloroethylene, 1-(alkoxycarbonyl-)ethylene, 1-alkoxycarbonyl-1-methylethylene, etc., (each is the constitutional repeating unit originated from styrene, acrylonitrile, methacrylonitrile, vinyl chloride, alkyl acrylate, alkyl methacrylate, etc.; as the alkyl group of the alkoxycarbonyl group, alkyl groups having 1 to 18 carbon atoms may be used; and practical examples of the alkyl group are a methyl group, an ethyl group, a hexyl group, a dodecyl group, an octadecyl group, and a 4-methylcyclohexyl group). In this case the constitutional repeating unit is by the definition described in Kobunshi, Vol. 27, pages 345–359 (1978), which is a Japanese translation of Pure and Applied Chemistry, Vol. 48, pages 373–385 (1976).

(ii) Aromatic tertiary amino compounds:

Examples of such compounds include triphenylamine, N,N-dibenzylaniline, diphenylbenzylamine, N,N-di(p-chlorobenzyl)aniline, di($\beta$-naphthyl)benzylamine, tri(p-tolyl)amine and diphenylcyclohexylamine.

(iii) Aromatic tertiary diamino compounds:

Examples of such compounds include N,N,N',N'-tetrabenzyl-p-phenylenediamine, N,N,N',N'-tetra(p-chlorobenzyl)-p-phenylenediamine, N,N,N',N'-tetramethyl-p-phenylenediamine, N,N,N',N'-tetrabenzyl-m-phenylenediamine, N,N,N',N'-tetramethylbenzidine, N,N,N',N'-tetrabenzylbenzidine, N,N,N',N'-tetraphenyl-p-phenylenediamine, N,N,N',N'-tetraphenyl-m-phenylenediamine, 1,1-bis[4-(dibenzylamino)phenyl]ethane, 1,1-bis[4-(dibenzylamino)phenyl]propane, 1,1-bis[4-(dibenzylamino)phenyl]-butane, 1,1-bis[4-(dibenzylamino)phenyl]-2-methylpropane, 2,2-bis[4-(dibenzylamino)phenyl]propane, 2,2-bis[4-(dibenzylamino)-phenyl]butane, 1,1-bis{4-[di(m-methylbenzyl)amino]-phenyl}propane, bis[p-(dimethylamino)-phenyl]-phenylmethane, bis[p-(diethylamino)phenyl]phenylmethane, bis[4-(dibenzylamino)phenyl]methane, bis{4-[di(p-chlorobenzyl)amino]phenyl}methane, 1,1-bis[p-(dimethylamino)phenyl]-1-phenylethane, 4,4'-benzylidene-bis(N,N-dimethyl-m-toluidine), 4',4''-bis(diethylamino)-2,6-dichloro-2',2''-dimethyltriphenylmethane, bis[4-(diethylamino)-2-methylphenyl]-$\alpha$-naphthylmethane, 4',4''-bis(dimethylamino)-2-chloro-2',2''-dimethyltriphenylmethane, 1,1-bis[p-(diethylamino)-phenyl]-1-phenylethane, 1,1-diphenyl-5,5-bis[4-(diethylamino)-2-methylphenyl]-1,3-pentadiene, 1,1-diphenyl-3,3-bis[4-(diethylamino)-2-methylphenyl]propene, bis[4-(dibenzylamino)phenyl]ether, bis[4-(diethylamino)phenyl] ether, bis[4-(dibenzylamino)phenyl] sulfide, 2,2-bis[4-(di-p-tolylamino)phenyl] propane, 1,1-bis[4-(di-p-tolylamino)phenyl]-1-phenylethane and bis[4-dibenzylamino]phenyl diphenylmethane.

(iv) Aromatic tertiary triamino compounds:

Examples of such compounds include tris-4-(diethylamino)phenyl methane and 1,1-bis[4-(diethylamino)-2-methylphenyl]-1-[4-(dimethylamino)-phenyl]methane.

(v) Condensation products:

Examples include condensation products of aldehydes and aromatic amines, condensation products of tertiary aromatic amines and aromatic halides, poly-p-phenylene-1,3,4-oxadiazole, condensation products of formaldehyde and condensed polycyclic aromatic compounds.

(vi) Metal-containing compounds:

Examples of such compounds include 2-mercaptobenzothiazole lead salt, 2-mercaptobenzothiazole zinc salt, 2-mercaptobenzothiazole copper salt, 2-mercaptobenzoxazole lead salt, 2-mercapto-5-phenylbenzoxazole lead salt, 2-mercapto-6-methoxybenzimidazole lead salt, 8-hydroxyquinoline magnesium salt, 8-hydroxyquinoline aluminum salt, 8-hydroxyquinoline lead salt, 7-benzyl-8-hydroxyquinoline copper salt and 2-hydroxy-4-methylazobenzene copper salt.

(vii) Heterocyclic compounds:

(a) Pyrazoline derivatives:

Examples of such derivatives include 1,3,5-triphenylpyrazoline, 1-phenyl-3-[p-(dimethylamino)styryl]-5-[p-(dimethylamino)phenyl]pyrazoline, 1,5-diphenyl-3-styrylpyrazoline, 1,3-diphenyl-5-styrylpyrazoline, 1,3-diphenyl-5-[p-(dimethylamino)phenyl]-pyrazoline, and 1,3-diphenyl-5-(2-furyl)pyrazoline.

(b) 1,2,4-Triazine derivatives:

Examples of such derivatives include 3-[p-(dimethylamino)phenyl]-5,6-bis(p-dimethoxyphenyl)-1,2,4-triazine, 3-[p-(dimethylamino)phenyl]-5,6-di(2-pyridyl)-1,2,4-triazine, 3-[p-(dimethylamino)phenyl]-5,6-di(p-ethoxyphenyl)-1,2,4-triazine, 3-[p-(diethylamino)-phenyl]-5,6-bis(p-methoxyphenyl)-1,2,4-triazine and 3-[p-(diethyl-amino)phenyl]-5,6-bis(p-ethoxyphenyl)-1,2,4-triazine.

(c) Quinazoline derivatives:

Examples of such derivatives include 2,4-diphenylquinazoline, 2-phenyl-4-p-tolylquinazoline, 2-phenyl-4-[4-(dimethylamino)phenyl]quinazoline, 2-phenyl-4-styrylquinazoline, and 2,4-diphenylbenzo[h]quinazoline.

(d) Benzofuran derivatives:

Examples of such derivatives include 6-hydroxy-2-phenyl-3-[4-(dimethylamino)phenyl]benzofuran, 6-hydroxy-2,3-di(4-methoxyphenyl)benzofuran, and 2,3,5,6-tetra(4-methoxyphenyl)benzo[1,2-b:5,4-b']difuran.

(e) Oxadiazole derivatives:

Examples of such derivatives include 2,5-bis[4-(dimethylamino)phenyl]-1,3,4-oxadiazole, 2,5-bis[4-(diethylamino)phenyl]-1,3,4-oxadiazole, 2,5-bis[4-(isoamylamino)phenyl]-1,3,4-oxadiazole, 2,5-bis[4-(cyclopentylamino)phenyl]-1,3,4-oxadiazole, and 2,5-bis[4-(ethylamino)phenyl]-1,3,4-oxadiazole.

Of the above organic photoconductive materials, materials (i), (ii), (iii), (viia), (viib) and (viid) are preferably used.

Preferred diacylamine compounds used in this invention are the compounds shown in general formula (I):

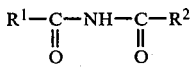

(I)

wherein $R^1$ and $R^2$ each represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic aryloxy group, or a monovalent group induced from a substituted or unsubstituted heterocyclic ring.

The diacylamine compounds shown by foregoing general formula (I) can be prepared by the methods described in Beilsteins Handbuch der Organischen Chemie, Vol. 9, pages 213–214. These diacylamine compounds are effective organic photoconductors and are also effective for dye-sensitized inorganic photoconductors such as ZnO, etc.

The alkyl group shown by $R^1$ and $R^2$ in general formula (I) may be a straight chain or branched alkyl group having 1 to 22 carbon atoms. Straight chain or branched alkyl groups having 1 to 5 carbon atoms are preferred.

Substituted alkyl groups shown by $R^1$ and $R^2$ include straight chain or branched substituted alkyl groups of 1 to 22 carbon atoms having bonded thereto 1 to 3 halogen atoms (e.g., a chlorine atom, a bromine atom, a fluorine atom, etc.), a cyano group, a nitro group, a phenyl group, or a tolyl group. Straight chain or branched alkyl groups having 1 to 5 carbon atoms are preferred as the alkyl groups.

$R^1$ and $R^2$ may be substituted alkoxy groups, examples of which include an alkoxy group wherein the alkyl moiety of the alkoxy group includes foregoing alkyl group or substituted alkyl group. An alkoxy group or a substituted alkoxy group each having 1 to 5 carbon atoms is preferred.

When $R^1$ and $R^2$ are a monocyclic or bicyclic condensed aryl group, they may be a phenyl group or naphthyl group.

$R^1$ and $R^2$ may be a substituted monocyclic or substituted bicyclic condensed aryl group, examples of the substituent are a halogen atom (chlorine atom, bromine atom, fluorine atom, etc.), a cyano group, a nitro group, a substituted or unsubstituted straight chain or branched alkyl group having 1 to 5 carbon atoms (in this case examples of the substituent are a halogen atom, a nitro group, a cyano group, etc.), a straight chain or branched alkoxy group having 1 to 5 carbon atoms, an alkoxycarbonyl group wherein the alkyl moiety of the alkoxycarbonyl group includes a straight or branched alkyl group of 1 to 5 carbon atoms, and a phenyl group or naphthyl group having 1 to 3 acyl groups wherein the alkyl moiety of the acyl group includes a straight chain or branched alkyl group of 1 to 5 carbon atoms.

$R^1$ and $R^2$ may be a substituted or unsubstituted monocyclic or bicyclic condensed aryloxy group, examples of the substituted aryloxy groups are aryloxy groups each having the foregoing substituted or unsubstituted monocyclic or bicyclic condensed aryl group.

Examples of the monovalent group induced from a monocyclic or bicyclic condensed heterocyclic group shown by $R^1$ and $R^2$ include a pyrrolidinyl group, a piperidinyl group, a piperidino group, a morpholinyl group, a morpholino group, a pyrrolyl group, an imidazolyl group, a pyridyl group, a pyridinyl group, an indolinyl group, an isoindolinyl group, an indolyl group, an isoindolyl group, a benzimidazolyl group, a quinolyl group and an isoquinolyl group. As the substituents for these groups, there are the substituents explained in regard to the substituted aryl groups.

In these diacylamine compounds used in this invention, those having a particularly remarkable sensitizing effect and having large effects with respect to showing good compatibility with an organic photoconductor, particularly poly-N-vinylcarbazole, poly-N-vinyl substituted carbazole, or a copolymer of N-vinylcarbazole or N-vinyl substituted carbazole, and improving the film-forming property of an electrophotographic light-sensitive layer of an electrophotographic light-sensitive material (i.e., giving films having desirable properties such as uniformity, toughness, and flexibility as well as a strong adhesion to a support) are the compounds shown by the following general formulae (II) to (IV). The compounds shown by general formula (III) have a particularly remarkable effect as a film-improving agent for a copolymer such as poly-N-vinylcarbazole, poly-N-vinyl substituted carbazole, or a copolymer of N-vinylcarbazole or N-vinyl substituted carbazole. These diacylamine compounds are also effective for a dye-sensitized zinc oxide photoconductor.

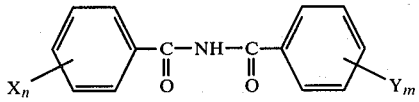

(II)

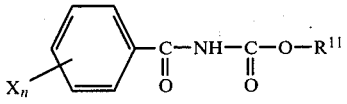

(III)

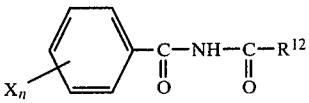

(IV)

wherein m and n each represents an integer of 0 to 3, which is the number of substituents; X and Y each represents a straight chain or branched alkyl group having 1 to 5 carbon atoms, a straight chain or branched alkyl group of 1 to 5 carbon atoms having the substituent as described in regard to $R^1$ and $R^2$, an alkoxy group having 1 to 5 carbon atoms, a halogen atom, a nitro group, or a cyano group; when m or n is 2 or 3, said Xs, Ys, or X and Y may be the same or different; $R^{11}$ represents a straight chain or branched alkyl group having 1 to 15 carbon atoms, a straight chain or branched alkyl group of 1 to 15 carbon atoms having 1 to 3 substituents as described in regard to $R^1$ and $R^2$, a phenyl group, or the substituted phenyl group as stated in regard to $R^1$ and $R^2$; and $R^{12}$ represents the same substituted or unsubstituted alkyl group same as that of $R^{11}$.

Practical examples of the compounds shown by general formula (II) are dibenzamide, p-nitrobenzoylbenzoylamine, m-nitrobenzoylbenzoylamine, p-cyanobenzoylbenzoylamine, m-cyanobenzoylbenzoylamine, p-chlorobenzoyl-p-nitrobenzoylamine, bis(m-chlorobenzoyl)amine, bis(m-nitrobenzoyl)amine, p-toluyl-p-nitrobenzoylamine, p-ethoxybenzoyl-m-nitrobenzoylamine, p-toluyl-p-cyanobenzoylamine, p-bromobenzoylbenzoylamine, bis(p-bromobenzoyl)amine, etc.

Practical examples of the compounds shown by general formula (III) are methyl N-benzoylcarbamate, ethyl N-benzoylcarbamate, ethyl N-(p-chlorobenzoyl)-carbamate, ethyl N-(p-nitrobenzoyl)carbamate, ethyl N-(m-nitrobenzoyl)carbamate, butyl N-(p-nitrobenzoyl)-carbamate, butyl N-(m-nitrobenzoyl)carbamate, ethyl N-(p-ethyloxycarbonylbenzoyl)carbamate, butyl N-(p-ethyloxycarbonylbenzoyl)carbamate, butyl N-(p-butyloxycarbonylbenzoyl)carbamate, etc.

Practical examples of the compounds shown by general formula (IV) are benzoylacetylamine p-chlorobenzoylacetylamine, p-bromobenzoylacetylamine, p-cyanobenzoylacetylamine, p-nitrobenzoylacetylamine, m-nitrobenzoylacetylamine, p-anisoylacetylamine, p-nitrobenzoylpropionylamine, m-nitrobenzoylpropionylamine, p-nitrobenzoylbutynylamine, m-nitrobenzoylbutynylamine, etc.

The ratio of the compound shown by general formula (I) in the photoconductive composition of this invention is determined by the relation with the amount of the organic photoconductor contributing the photoconductivity. The compound shown by general formula (I) is generally present in an amount of from 0.1 part by weight to 100 parts by weight, preferably from 0.5 part by weight to 30 parts by weight, per 100 parts by weight of the organic photoconductor. If the compound is added in an amount outside the foregoing range of the addition ratio, there is a tendency of reducing the light sensitivity of the photoconductive composition or increasing the residual potential.

The photoconductive composition of this invention containing an organic photoconductor and the compound shown by general formula (I) may further contain a sensitizing dye which can increase the light sensitivity of the organic photoconductor for further increasing the sensitivity of the photoconductive composition.

The sensitizing dye used in this invention may be a well known sensitizing dye used for the dye sensitizing technique of organic photoconductors. Typical sensitizing dyes are disclosed in Society of Photographic Scientists and Engineers, 19, 60–64 (1975), Applied Optics, Suppl., 3, 50 (1969), U.S. Pat. Nos. 3,037,861, 3,250,615, and 3,712,811, British Pat. No. 1,353,264, Research Disclosure, #10938 (109, May, 1973, page 62 below), U.S. Pat. Nos. 3,141,700 and 3,938,994, Japanese Patent Application (OPI) Nos. 14560/81, 14561/81, 29586/81, 29587/81, 65885/81 and 35141/81 (the term "OPI" as used herein refers to a "published unexamined Japanese Patent Application"), Japanese Patent Application No. 114259/80, etc., and the sensitizing dye used in this invention may be selected from these known dyes and other dyes capable of increasing the light sensitivity of high molecular organic photoconductors.

Practical examples of the sensitizing dyes used in this invention are as follows:

Triphenylmethane series dyes such as Brilliant Green, Victoria Blue B, Methyl Violet, Crystal Violet, Acid Violet 6B, etc.; rhodamines such as Rhodamine B, Rhodamine 6G, Rhodamine G Extra, Sulforhodamine B, Fast Acid Eosine G, etc.; xanthene series dyes such as Eosine S, Eosine A, Erythrosine, Phloxine, Rose Bengale, fluorescein, etc.; thiazine dyes such as Methylene Blue, etc.; acridine dyes such as Acridine Yellow, Acrydine Orange, Trypaflavin, etc.; quinoline dyes such as pinacyanol, cryptocyanine, etc.; quinone dyes and ketone dyes such as Alizarine, Alizarine Red S, quinizarine, etc.; cyanine dyes; chlorophyll; arylmethane dyes such as Violet Fuchsine; Erythrosine 2Na, Rhodamine B500, Fanal Pinc B, Rhodamine 6GDN, Auramine, etc.; polymethine dyes such as 3,3'-diethyl thiacarbocyanine iodide, etc.; azo dyes such as Eriochrome Blue Black R, etc.; azomethine dyes such as bis(p-dimethylaminobenzal)azine, etc.; carbonyl dyes such as Solway Ultra Blue B, Alizarine Cyanine Green GWA, etc.; heterocyclic compounds such as N,N-pentamethylene bis(benzthiazol perchlorate, etc.; phthalocyanine dyes such as Segnale, Light, Turquoise NB, etc.; and pyrylium dyes such as 2,6-di-t-butyl-4-(2,6-di-t-butyl-4H-thiopyran-4-indenemethyl)thiapyrylium salt, 2,6-di-t-butyl-4-[3-(2,6-di-t-butyl-4H-thiapyran-4-indene)propen-1-yl]thiapyrylium salt, 2,6-diphenyl-4-(4-diethylaminophenyl)thiapyrylium salt, 2,6-di-t-butyl-4-(4-diethylaminostyryl)thiapyrylium salt, etc.

These sensitizing dyes are used in an amount capable of sensitizing organic photoconductors and the amount of the sensitizing dye depends upon the kinds of the organic photoconductor and the sensitizing dye used but is generally in a range of from about 0.01 part by weight to about 100 parts by weight, preferably from about 0.1 part by weight to about 30 parts by weight, per 100 parts by weight of the organic photoconductor.

The photoconductive composition of this invention may also contain structure agents, plasticizers, dyes, pigments, etc., in the amounts by which the characteristics of the photoconductive composition of this invention are not reduced.

Useful structure agents include cyanoethyl cellulose, nitrile rubber, polycarbonate of bisphenol A, linear polyester, a styrene-butadiene copolymer, and a vinylidene chloride-acrylonitrile copolymer. Useful plasticizers include biphenyl chloride, epoxy resin, triphenylmethane compounds, coumarone resin and low molecular xylene resin.

The photoconductive composition of this invention is prepared by dispersing or dissolving the foregoing two main components together with, if necessary, other additives in a dispersion medium or a solvent to form a dispersion or a homogeneous solution. The dispersion or solution is then coated on a proper support, and the solvent is removed along with the dispersion medium by a means such as evaporation. Depending on the purpose, the dispersion or solution of the photoconductive composition may be used as it is without removing the dispersion medium or the solvent. The electrophotographic light-sensitive material of this invention is prepared by coating the dispersion or solution of the photoconductive composition prepared as described above on a proper support having a conductive surface and drying to provide a photoconductive layer on the support. According to the purposes, the photoconductive layer composed of the photoconductive composition may be laminated on a support having a conductive surface using an adhesive layer, etc.

The solvent or dispersion medium used for preparing the liquid coating composition of the photoconductive composition of this invention may be benzene, toluene, xylene, chlorobenzene, dichloromethane, dichloroethane, trichloroethane, cyclohexanone, tetrahydrofuran, dioxane, etc., and mixtures of them. That is, a material which can dissolve or disperse an organic photoconductor, the compound shown by general formula (I) and, if necessary, additives as described above may be selected from the foregoing solvents or dispersions.

The support having a conductive surface used in this invention may be a drum or sheet of a metal such as aluminum, copper, iron, zinc, etc., and a paper, a plastic film, a glass sheet, etc., which is subjected to a surface conductive treatment by the vapor-deposition of a metal such as aluminum, copper, zinc, indium, etc., the vapor-deposition of a conductive metal compound (e.g., $In_2O_3$, $SnO_2$, etc.), the lamination of a metal foil, or by coating a dispersion of carbon black, a conductive metal compound (e.g., $In_2O_3$, $SnO_2$, etc.), or a metal powder in a binder polymer.

According to this invention, by incorporating the compound shown by general formula (I) in a photoconductive composition containing an organic photoconductor, an electrophotographic light-sensitive material having highly sensitized sensitivity can be obtained without reducing the transparency, the lightweight property, and the mechanical strength thereof.

The photoconductive composition of this invention may be dispersed in an insulating solvent as fine particles thereof and images can be formed by the electrophoretic photographic imaging process described in, for example, U.S. Pat. Nos. 3,384,565, 3,384,488, 3,510,419, etc.

The invention will now be practically described in more detail by the following examples. However, the scope of the invention is not limited to these examples.

EXAMPLE 1

A solution was prepared by dissolving 1 g of poly-N-vinylcarbazole in 20 ml of 1,2-dichloroethane and to the solution was added 25 mg of 2,6-di-t-butyl-4-[4-(N-methyl-N-2-cyanoethylamino)styryl]thiapyrylium tetrafluoroborate.

The foregoing solution was coated on a polyethylene terephthalate (PET) film 100 μm thick having a vapor-deposited $In_2O_3$ layer 60 nm thick and dried to remove the solvent. Thereby electrophotographic light-sensitive film No. 1 (comparison sample) having a photoconductive layer (electrophotographic light-sensitive layer) 5 μm thick was prepared.

A poly-N-vinylcarbazole solution having the same composition as above was prepared and each of the diacylamine compounds described in Table 1 was dissolved in the solution in the amount shown in the same table per 100 parts by weight of poly-N-vinylcarbazole. The resultant solution was coated on a PET film having a vapor-deposited $In_2O_3$ layer as above described and dried to remove the solvent. Thereby a photoconductive layer 5 μm thick was formed. Thus, electrophotographic light-sensitive films No. 2 to No. 17 of this invention were prepared.

The sensitivity of the photoconductive layer of each of the electrophotographic light-sensitive films No. 1 to No. 17 was measured. The sensitivity measurement was performed by measuring the exposure amount ($E_{50}$) required for light-decaying the initial electric potential (500 volts) to ½ thereof and also the exposure amount ($E_{90}$) required for light-decaying the same initial electric potential to 1/10 thereof. The results are shown in Table 1. A monochromatic light having a wavelength of 630 nm was used as the light source.

EXAMPLE 2

By following the same procedure as in the cases of preparing the electrophotographic light-sensitive films No. 1, No. 2 and No. 3 in Example 1 except that 25 mg of 2,6-di-t-butyl-4-[4-(N,N-dichloroethylamino)styryl]-thiapyrylium tetrafluoroborate or 25 mg of Rhodamine B (C.I. #45170) was used in place of 25 mg of 2,6-di-t-butyl-4-[4-(N-methyl-N-2-cyanoethylamino)-styryl]-thiapyrylium tetrafluoroborate used in Example 1, electrophotographic light-sensitive films No. 18 (comparison sample), No. 19, No. 20, No. 21 (comparison sample), No. 22 and No. 23 were prepared. The sensitivity of each sample was measured in the same manner as in Example 1. The results obtained are shown in Table 2.

EXAMPLE 3

By following the same procedure as when preparing the electrophotographic light-sensitive films No. 1, No. 2, and No. 3 in Example 1 except that a PET film having a fine $SnO_2$ powder/gelatin layer prepared by the method described in the following pages was used in place of the PET film having the vapor-deposited $In_2O_3$ layer used in Example 1, electrophotographic light-sensitive films No. 24 (comparison sample), No. 25 and No. 26 were prepared. The sensitivity of each sample film was measured in the same manner as in Example 1. The results obtained are shown in Table 2.

TABLE 1

| Sample No. | Diacylamine Compound | Addition Amount (wt. part) | $E_{50}$ (erg/cm$^2$) | $E_{90}$ (erg/cm$^2$) |
|---|---|---|---|---|
| 1 (Comparison) | — | — | 65 | 430 |
| 2 | (A) | 1 | 50 | 324 |
| 3 | " | 5 | 36 | 209 |
| 4 | (B) | 5 | 49 | 314 |
| 5 | " | 10 | 41 | 233 |
| 6 | (C) | 5 | 48 | 306 |
| 7 | " | 10 | 40 | 230 |
| 8 | (D) | 5 | 46 | 290 |
| 9 | " | 10 | 40 | 232 |
| 10 | (E) | 1 | 50 | 315 |
| 11 | " | 5 | 44 | 278 |
| 12 | (F) | 1 | 52 | 333 |
| 13 | " | 5 | 43 | 250 |
| 14 | (G) | 5 | 44 | 234 |
| 15 | " | 10 | 40 | 228 |
| 16 | (H) | 5 | 41 | 228 |

TABLE 1-continued

| Sample No. | Diacylamine Compound | Addition Amount (wt. part) | $E_{50}$ (erg/cm$^2$) | $E_{90}$ (erg/cm$^2$) |
|---|---|---|---|---|
| 17 | " | 10 | 38 | 202 |

(A): $O_2N$

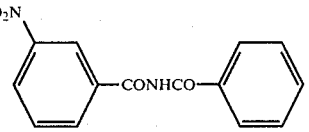

(B): EtCONHCOEt (Et: ethyl)
(C): MeCONHCOMe (Me: methyl)
(D):

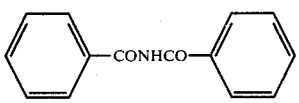

(E): $O_2N$ $NO_2$

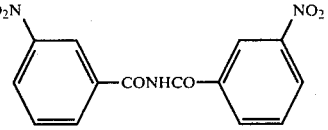

(F):

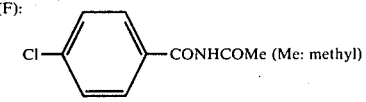

(G): $O_2N$

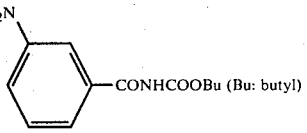

(H):

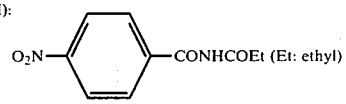

TABLE 2

| Sample No. | Dye | Diacyl-amine Compound | Addition Amount (wt part) | $E_{50}$ (erg/cm$^2$) | $E_{90}$ (erg/cm$^2$) |
|---|---|---|---|---|---|
| 18 (Comparison) | (I) | (A) | 0 | 60 | 412 |
| 19 | " | " | 1 | 48 | 310 |
| 20 | " | " | 5 | 35 | 193 |
| 21 (Comparison) | (II) | " | 0 | 140 | 1,020 |
| 22 | " | " | 1 | 110 | 876 |
| 23 | " | " | 5 | 84 | 500 |
| 24 (Comparison) | (III) | " | 0 | 66 | 441 |
| 25 | " | " | 1 | 50 | 320 |
| 26 | " | " | 5 | 35 | 212 |

(I): 2,6-di-t-butyl-4-[4-(N,N—dichloroethylamino)styryl]thiapyrylium tetrafluoroborate
(II): Rhodamine B
(III): Same as the dye used in the case of preparing the electrophotographic light-sensitive film No. 1 in Example 1
(A): $O_2N$

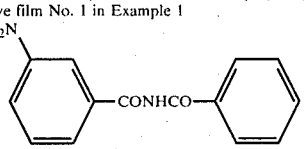

EXAMPLE 4

By following the same procedure as in Example 1 except that the diacylamine compound and the sensitizing dye used in Example 1 were not used, electrophotographic light-sensitive film No. 27 (comparison sample) was prepared. Also, by following the same procedure as in Example 1 except that the sensitizing dye was not used and 5 parts by weight of m-nitrobenzoylamine was used as a diacylamine compound, electrophotographic light-sensitive film No. 28 was prepared.

The sensitivity of each sample film was measured in the same manner as in Example 1. The results are shown in Table 3. A halogen lamp was used as the light source.

TABLE 3

| Sample No. | Dye | Diacylamine Compound (wt. part) | $E_{50}$ (lux · sec) | $E_{90}$ (lux · sec) |
|---|---|---|---|---|
| 27 (Comparison) | 0 | 0 | —* | —* |
| 28 | 0 | 5 | 220 | 1,800 |

*The sensitivity was too low to be measured.

The PET film having a conductive layer containing $SnO_2$ fine powder dispersed in gelatin was prepared as follows.

(1) A mixture of 65 parts by weight of stannic chloride hydrate and 1.5 parts by weight of antimony trichloride was dissolved in 1,000 parts by weight of ethanol to prepare a uniform solution. To the uniform solution thus-obtained was dropwise added a 1 N aqueous sodium hydroxide solution until the pH of the solution reached 3 to thereby obtain co-precipitated colloidal stannic oxide and antimony oxide. The thus-obtained co-precipitated product was allowed to stand at 50° C. for 24 hours to obtain a red-brown colloidal precipitate.

The red-brown colloidal precipitate thus-obtained was separated with a centrifugal separator. In order to remove excessive ions, water was added to the precipitate and the resulting mixture was subjected to centrifugal separation to wash the precipitate. This procedure was repeated three times to remove excessive ions.

The thus-obtained excessive ion-free colloidal precipitate (100 parts by weight) was mixed with 50 parts by weight of barium sulfate having an average grain size of 0.3μ and 1,000 parts by weight of water. The resulting mixture was sprayed in a burning furnace maintained at 900° C. to obtain a bluish powdery mixture comprising stannic oxide and barium sulfate and having an average grain size of 0.1μ.

The thus-obtained mixture (1 g) was placed in an insulative cylinder having an inner diameter of 1.6 cm. The specific resistance of the powder was measured with stainless steel electrodes while sandwiching the powder with the stainless steel electrodes at a pressure of 1,000 kg/cm$^2$, and it was found to be 11 Ω-cm.

| | | |
|---|---|---|
| (2) | $SnO_2$ Powder obtained in the above step (1) | 10 parts by weight |
| | Water | 150 parts by weight |
| | 30% Aqueous solution of ammonia | 1 part by weight |

A mixture comprising the foregoing ingredients was dispersed for 1 hour with a paint shaker to obtain a uniform dispersion. This uniform dispersion was subjected to centrifugal separation at 2,000 rpm for 30 minutes to remove large particles. The supernatant liquid thus-obtained was subjected to centrifugal separation at 3,000 rpm for 1 hour to obtain an $SnO_2$ paste comprising fine particles.

The thus-obtained $SnO_2$ paste (10 parts by weight) was mixed with 25 parts by weight of a 10% aqueous solution of gelatin and 100 parts by weight of water, and the resulting mixture was dispersed for 1 hour with a paint shaker to obtain an electrically-conductive coating solution.

The electrically-conductive coating solution was coated on a 100 μm polyethylene terephthalate (PET) film in a dry coating amount of 2 g/m$^2$ to obtain an electrically-conductive support.

It can be seen from the above results in Tables 1, 2 and 3 that the electrophotographic films of the invention having an electrophotographic light-sensitive layer containing diacylamine compound are of higher sensitivity than the electrophotographic films having an electrophotographic light-sensitive layer being free from the diacylamine compound.

While the invention has been described in detail and with reference to specific embodiments thereof, it will be apparent to one skilled in the art that various changes and modifications can be made therein without departing from the spirit and scope thereof.

What is claimed is:

1. A photoconductive composition comprising an organic photoconductor and a diacylamine compound as the main components.

2. The photoconductive composition as claimed in claim 1, wherein the photoconductive composition further contains a sensitizing dye capable of increasing the light sensitivity or the organic photoconductor contained therein.

3. The photoconductive composition as claimed in claim 1, wherein the diacylamine compound is present in an amount of 0.1 part by weight to 100 parts by weight per 100 parts by weight of the organic photoconductor.

4. The photoconductive composition as claimed in claim 2, wherein the sensitizing dye is present in an amount of 0.01 part by weight to about 100 parts by weight per 100 parts by weight of the organic photoconductor.

5. The photoconductive composition as claimed in claim 1 or 2, wherein the diacylamine compound is represented by general formula (I):

$$R^1-\underset{\underset{O}{\|}}{C}-NH-\underset{\underset{O}{\|}}{C}-R^2 \qquad (I)$$

wherein $R^1$ and $R^2$ each represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic condensed aryloxy group, or a monovalent group induced from a substituted or unsubstituted heterocyclic ring.

6. An electrophotographic light-sensitive material comprising a support, at least the surface of which has an electric conductivity, having formed thereon an electrophotographic light-sensitive layer comprising a photoconductive composition containing an organic photoconductor and a diacylamine compound as main components.

7. The electrophotographic light-sensitive material as claimed in claim 6, wherein the photoconductive composition further contains a sensitizing dye capable of increasing the light sensitivity of the organic photoconductor.

8. The electrophotographic light-sensitive material as claimed in claim 6, wherein the diacylamine compound is present in an amount of 0.1 part by weight to 100 parts by weight per 100 parts by weight of the organic photoconductor.

9. The electrophotographic light-sensitive material as claimed in claim 7, wherein the sensitizing dye is present in an amount of 0.01 part by weight to about 100 parts by weight per 100 parts by weight of the organic photoconductor.

10. The electrophotographic light-sensitive material as claimed in claim 6, wherein the diacylamine compound is represented by general formula (I):

$$R^1-\underset{\underset{O}{\|}}{C}-NH-\underset{\underset{O}{\|}}{C}-R^2 \qquad (I)$$

wherein $R^1$ and $R^2$ each represents an alkyl group, a substituted alkyl group, an alkoxy group, a substituted alkoxy group, a substituted or unsubstituted monocyclic or bicyclic condensed aryl group, a substituted or unsubstituted monocyclic or bicyclic condensed aryloxy group, or a monovalent group induced from a substituted or unsubstituted heterocyclic ring.

* * * * *